United States Patent [19]

Ito et al.

[11] Patent Number: 4,473,028

[45] Date of Patent: Sep. 25, 1984

[54] DEVELOPING DEVICE

[75] Inventors: Kunio Ito; Ken Nakamura, both of Hachioji, Japan

[73] Assignee: Konishiroku Photo Industry Co., Ltd., Tokyo, Japan

[21] Appl. No.: 402,725

[22] Filed: Jul. 28, 1982

[30] Foreign Application Priority Data

Aug. 10, 1981 [JP] Japan ..... 56-124111

[51] Int. Cl.[3] ..... G03G 15/00

[52] U.S. Cl. ..... 118/653; 355/3 DD

[58] Field of Search ..... 118/653; 355/3 DD

*Primary Examiner*—Bernard D. Pianalto

*Attorney, Agent, or Firm*—Jordan B. Bierman; Linda Bierman

[57] ABSTRACT

A developing device for use in an electrophotographic copying machine or electrostatic recording apparatus includes a stirring blade for mixing the developer. The driven shaft driving the stirring blade is intermittently revolved in a reverse direction to the main driving shaft directly connected to the developing sleeve by a mechanism incorporated between the main shaft and the driven shaft.

6 Claims, 2 Drawing Figures

DEVELOPING DEVICE

BACKGROUND OF THE INVENTION

1. Field of the Invention

The present invention relates to a developing device to be used in an electrophotographic copying machine or, an electrostatic recording apparatus, and more particularly to a means for driving a developer stirring blade in the developing device.

2. Description of the Prior Art

In a dry type developing device, as is generally known, a stirring blade is built therein for the purposes of frictionally charging a developer stored therein and of uniformly mixing recovered and/or replenishment toner with other developer.

Heretofore, the structures of the stirring blades with the aforesaid purposes have so far been improved in various ways to uniformly mix up the developer within a short period of time by whatever configuration or structure the stirring blade has. In other words, the conventional stirring blades have been devised so as to tilt in the reverse direction or to alternately change the direction right and left, all of which has been driven to revolve in one direction at a constant speed. Part of the developer is rapidly stirred but there is caused an area where no stirring has been carried into effect locally, and therefore it takes a long time until the developer is satisfactorily mixed up overall. Recently in particular, because of the tendencies to accelerate the copying speeds and to stir the developer insufficiently, other problems have arisen such as an image unevenness.

SUMMARY OF THE INVENTION

The present invention provides a means for driving a stirring blade capable of satisfactorily stirring and mixing the stored developers overall within a short period of time, in consideration of the actual circumstances described above.

DETAILED DESCRIPTION OF THE PREFERRED EMBODIMENTS

The following is the detailed description of the examples of the present invention with reference to the drawings thereof.

Figure 1:
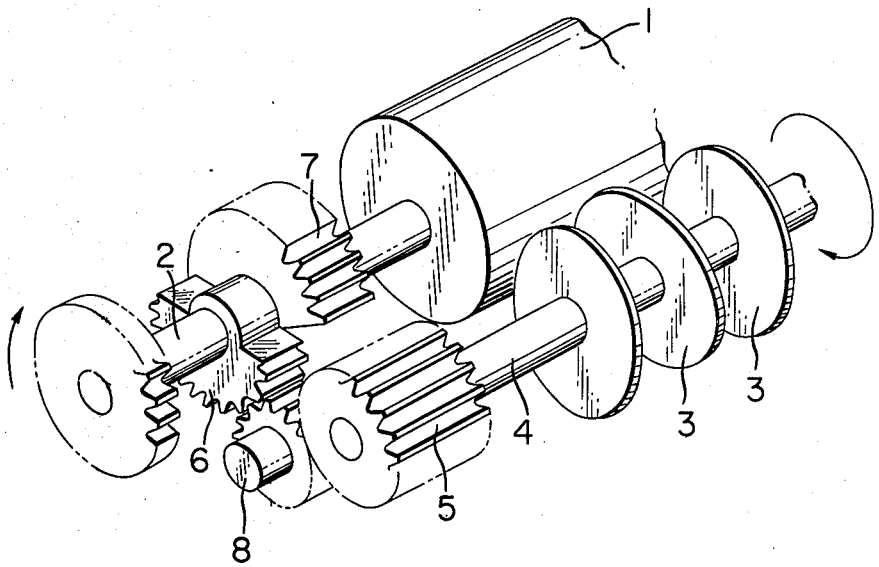
FIG. 1 shows a perspective view of a stirring blade driving device of the first example embodied in the present invention.

FIG. 1 illustrates a first example of the present invention, wherein a main driving shaft 2 which is directly connected to a developing sleeve 1 is revolvingly driven in succession in the direction of the arrow by means of a motor which is not shown in the drawing. A wide driven pinion 5 is fixed to the end of a driven shaft 4 which supports stirring blades 3 such as screws and slanting cascade blades. To said main driving shaft 2, a sectorial driving gear 6 and a sectorial reversing gear 7 are fixed so as to be adjacently juxtaposed in the axial direction. Said sectorial driving gear 6 is capable of engaging intermittently with counter gear 8 which is constantly engaged with said driven pinion 5. The sectorial reversing gear 7 is positioned on the same plane with the driven pinions which are off set in the direction of a right angle to the main driving shaft 2. In this connection, the sectorial reversing gear 7 is engaged with the driven pinion 5 to drive said driven shaft 4 in reverse while the driven pinion 5 remain undriven by the sectorial driving gear 6.

The device of the example is constructed as mentioned above, whereby, the driven shaft 4 is repeatedly revolved back and forth only by constantly driving the main driving shaft 2 in the direction of the arrow, and consequently, the developers are satisfactorily stirred up overall by the back-and-forth revolution of said stirring blade 3.

Figure 2:
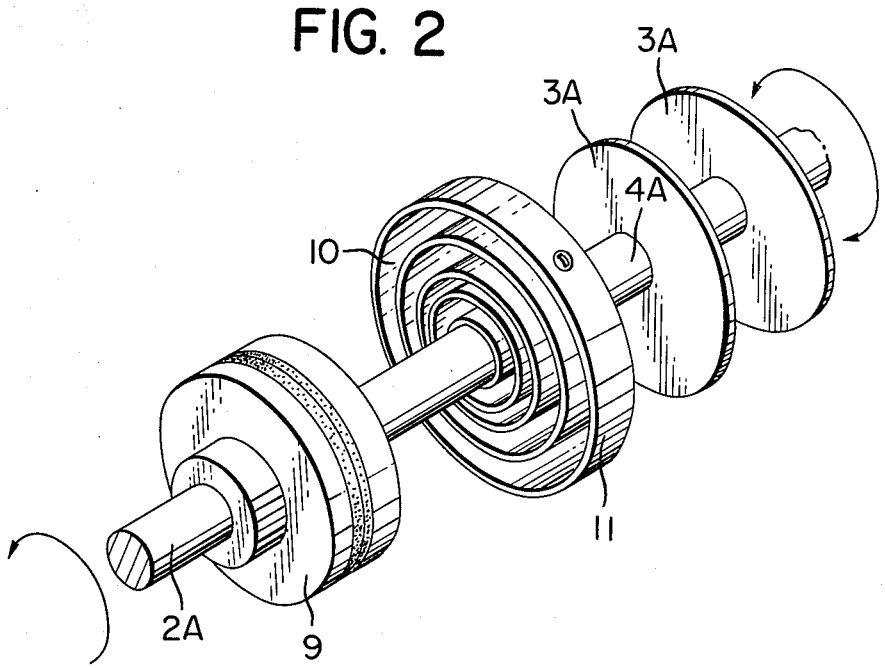
FIG. 2 shows a perspective view of a stirring blade driving device of the second example embodied in the present invention.

FIG. 2 is a second example of the present invention, wherein a main driving shaft 2A is intermittently revolved in the direction of the arrow, and one end of a flat spiral spring 10 is fixed to the end of said main driving shaft 2A. A holder 11 is fixed to the end of flat spiral spring 10 and said holder is fixed to the end of the driven shaft 4A which supports stirring blades 3A. When the main driving shaft 2A is revolved in the direction of the arrow, the stirring blades 3A are revolved in the same direction as that of the main shaft 2A, at the same time that the flat spiral spring 10 is being energized.

Then, when the main driving shaft 2 is stopped in motion, the stirring blades 3A are revolved in reverse by the accumulated energy of the flat spiral spring 10, and consequently it provides similar functional effects to those in the first example.

In conclusion, in accordance with the present invention, stirring blades are intermittently revolved back and forth repeatedly, so that the whole amount of developers can be satisfactorily stirred and mixed up within a short period of time, and thus a high quality of development can be obtained also in a high-speed developing device.

What is claimed is:

1. In a developing device in which a developer is frictionally charged and is unified by a stirring blade, said developing device comprising a main driving shaft driven by a driving power source, a stirring blade for stirring the developer, a driven shaft driving said stirring blade, and a mechanism incorporated in between said main driving shaft and said driven shaft so as to intermittently revolve the driven shaft in the reverse direction to the main driving shaft.

2. A developing device according to claim 1, wherein said device comprises a plurality of the stirring blades.

3. A developing device according to claim 1 or 2, wherein said mechanism comprises a driven pinion fixed to said driven shaft, a sectorial driving gear and a sectorial reversing gear fixed so as to be adjacently juxtaposed in the axial direction, and a counter gear constantly engaged with the driven shaft and intermittently engaging with the sectorial driving gear.

4. A developing device according to claim 1 or 2, wherein said mechanism comprises a flat spiral spring fixed to said driven shaft at one end of said spring.

5. A developing device according to claim 4, wherein said mechanism further comprises a holder fixed to the other end of said spring.

6. A developing device according to claim 1 or 2, wherein said main driving shaft is arranged as a rotating shaft of a developing sleeve.

* * * * *